United States Patent [19]

Wikman

[11] Patent Number: 4,927,499

[45] Date of Patent: May 22, 1990

[54] APPARATUS FOR STABILIZING THE JET FLOW EXITING A HEADBOX OF A PAPER MACHINE

[75] Inventor: Kai Wikman, Virkkala, Finland

[73] Assignee: Valmet-Ahlstrom, Inc., Karhula, Finland

[21] Appl. No.: 286,517

[22] Filed: Dec. 19, 1988

[30] Foreign Application Priority Data

Dec. 23, 1987 [FI] Finland ..... 875693

[51] Int. Cl.[5] ..... D21F 1/02

[52] U.S. Cl. ..... 162/336; 162/344; 162/346

[58] Field of Search ..... 162/336, 342, 343, 344, 162/346, 353

[56] References Cited

U.S. PATENT DOCUMENTS

| | | | |
|---|---|---|---|
| 2,956,623 | 10/1960 | Ikavalko . | |
| 3,434,923 | 3/1969 | Dennis . | |
| 4,081,321 | 3/1978 | Wolf et al. | 162/346 |
| 4,137,124 | 1/1979 | Bubik et al. | 162/344 |
| 4,687,548 | 8/1987 | Ilmoniemi et al. | 162/336 |

FOREIGN PATENT DOCUMENTS

| | | | |
|---|---|---|---|
| 197806 | 6/1978 | Fed. Rep. of Germany | 162/344 |
| 3514554 | 3/1986 | Fed. Rep. of Germany . | |
| 30095 | 5/1959 | Finland . | |
| 43812 | 3/1971 | Finland . | |
| 850638 | 6/1986 | Finland . | |
| 844276 | 2/1988 | Finland . | |
| 362535 | 12/1931 | United Kingdom | 162/346 |

OTHER PUBLICATIONS

E. Weisshuhn and H. Dahl: Einflues des Stofflaufs auf Blatteigenschaften und deren Konstanz. Das Papier, 10A, 151–164, (1986).

D. Egelhof: Der Einflus des Stoffauflaufes auf Asymetriefehler im Papier. Das Papier, 7, 313–318, (1986).

P. Soikkanen: Sym-Flow, the Versatile Headbox, Fifth Valmet Paper Machine Days, 1986.

*Primary Examiner*—Karen M. Hastings

*Attorney, Agent, or Firm*—Cohen, Pontani & Lieberman

[57] ABSTRACT

Apparatus for stabilizing a jet flow (J) discharged from a headbox slice channel (16) of a paper machine and for controlling the edge area of a paper or board web. In the flow direction (F) of the stock suspension, the slice channel (16) narrows and converges in the edge areas thereof, on both sides in cross direction of the web formed. The top wall (25) of an apron beam (24) forms the bottom wall of the slice channel (16). The slice channel (16) is defined by a planar top wall (14), which is hinge-jointed at the upstream edge of adjustment of the slice opening (15). At the level of the bottom wall (25), the slice channel (16) narrows and converges linearly from the full width ($L_{max}$) of a turbulence generator (13) down to the width ($L_0$) of the slice opening. At the level of the top wall (14) of the slice channel (16) the width of the slice channel (16) is essentially retained the same and equal to the width ($L_0$) of the slice opening.

10 Claims, 3 Drawing Sheets

APPARATUS FOR STABILIZING THE JET FLOW EXITING A HEADBOX OF A PAPER MACHINE

FIELD OF THE INVENTION

The invention relates to a method and apparatus for stabilizing the stock jet discharged from the headbox outlet of a paper machine and for controlling the edge areas of the paper or board web to be manufactured.

BACKGROUND OF THE INVENTION

In the past attempts have been made to achieve, in the slice flow of the stock suspension, an even cross-directional profile of the machine direction velocity. Likewise, it has been known that detrimental cross velocities may occur in the said flow. Especially this has caused problems in the edge areas of the web, for instance, by intensifying the edge wave.

The reason for achieving even velocity is to produce paper that is homogeneous as to its grammage, formation and strength along its entire width.

A web produced with any of the present paper machine headboxes is more or less non-homogeneous in the edge areas. There are several methods to detect non-homogeneity; e.g. by measuring the characteristics of the paper or board web. Characteristics to be measured might include e.g. the grammage, tensile strength (cross direction), elongation (cross direction), tearing resistance and other similar variables. When measuring the above-mentioned variables at various points across the web, it is seen that the characteristics measured at the edges and those measured in the middle area of the web are unequal. This unequality of the characteristics indicates variations in the quality of the web and in the extreme cases portions of the web width might have to be rejected. The critical degree of the unequality in characteristics is dependent on the quality and use of the paper. To illustrate this, laser copying paper might be mentioned; the fiber orientation in this kind of paper has to be very even and, at the same time, its homogeneity very high.

The impact of the headbox slice on these variables has for instance been dealt with in the following sources:

(1) E. Weisshuhn und Dahl Einfluss des Stoffauflaufs auf Blatteigenschaften und deren Konstanz, Das Papier 10A, 1986 p. 151–164.

(2) D. Egelhof Der Einfluss des Stoffauflaufes auf Asymmetriefehler im Papier, Das Papier 7, 1986 p. 313–318.

(3) P. Soikkanen Sym-flow, the versatile headbox. Fifth Valmet Paper Machine Days 1986

Various alternatives to correct the asymmetry are presented in these sources.

In addition to these, various reasons and solution models for stabilizing the jet flow across the entire width of the web, have been presented in reference (4)

E. Weisshuhn et al. DE patent application No. 3 514 554

The solutions presented in reference (4) require various adjustments when the flow and production conditions change and some of the solutions are expensive to realize and their reliable function is questionable. The solution presented in reference (3) requires very complicated adjustment procedures in all production conditions. The procedure in question involving several test samples and time-consuming measurements is not to be recommended for a process which is very fast and has high operating costs.

It is also previously known to remove a small portion of the stock flow on each side of the channel between the slice and the rectifier roll of the headbox, before it is discharged onto the wire (e.g. Finnish patent No. 43 812. Beloit Corporation). Also previously known is a solution contrary to this where an additional flow of water is introduced through the side wall (Finnish patent No. 30095, Valmet Oy) but, as far as is known, the latter has not been realized in practice.

A method and apparatus for controlling fiber orientation misalignment in the paper web in the paper machine headbox is disclosed in Valmet Oy's Finnish patent application Nos. 844276 and 850638. In the method of the Finnish application No. 844276 medium flows are introduced at both opposite edge areas of the flow channel thereby controlling the fiber orientation misalignment.

In the method of the Finnish application No. 850638 the edge flows are introduced via edge flow channels fitted on both sides of a turbulence generator or the like of the headbox, and to control the fiber orientation misalignment, the volume of flows at the edges is controlled by adjusting the cross sectional area of the edge flow channels by special means.

There is an increasing need for adjusting the stock jet velocity profile in fast paper machines, when the object is to affect the fiber orientation. An even fiber orientation in the paper web is essential also because, in the drying section, when the paper shrinks, the degree of shrinkage is highest in the length direction of the fibers. With an even degree of shrinkage, a paper web of even tightness across the entire width of the we is obtained. The leaning tendency of a stack of forms has also been observed to be due to unequal fiber orientation.

SUMMARY OF THE INVENTION

It is an object of the present invention to provide a method and apparatus for stabilizing the jet flow in a headbox of a paper machine by means of which the drawbacks described above can be avoided.

It is a particular object of the invention to provide a method and apparatus, as defined above, the construction of which is advantageous, the function of which is secure and thus self-controlling in order to avoid complicated controlling procedures and systems.

In order to achieve the objects described above and those to be described below, the method according to the invention is characterized in that a slice channel is used which narrows and converges in cross direction in the edge areas on both sides of the web formed in the flow direction of the stock.

The apparatus according to the invention, on the other hand, is mainly characterized in that both opposite side walls of a slice channel deviate from a vertical machine direction plane in the way that the slice channel narrows in the flow direction at both edges in cross direction.

BRIEF DESCRIPTION OF THE DRAWINGS

In the following the invention is described in detail referring to a preferred embodiment shown in the attached drawings, the invention being by no means restricted to the details of the embodiment.

DESCRIPTION OF A PRESENTLY PREFERRED EMBODIMENT

Figure 1:
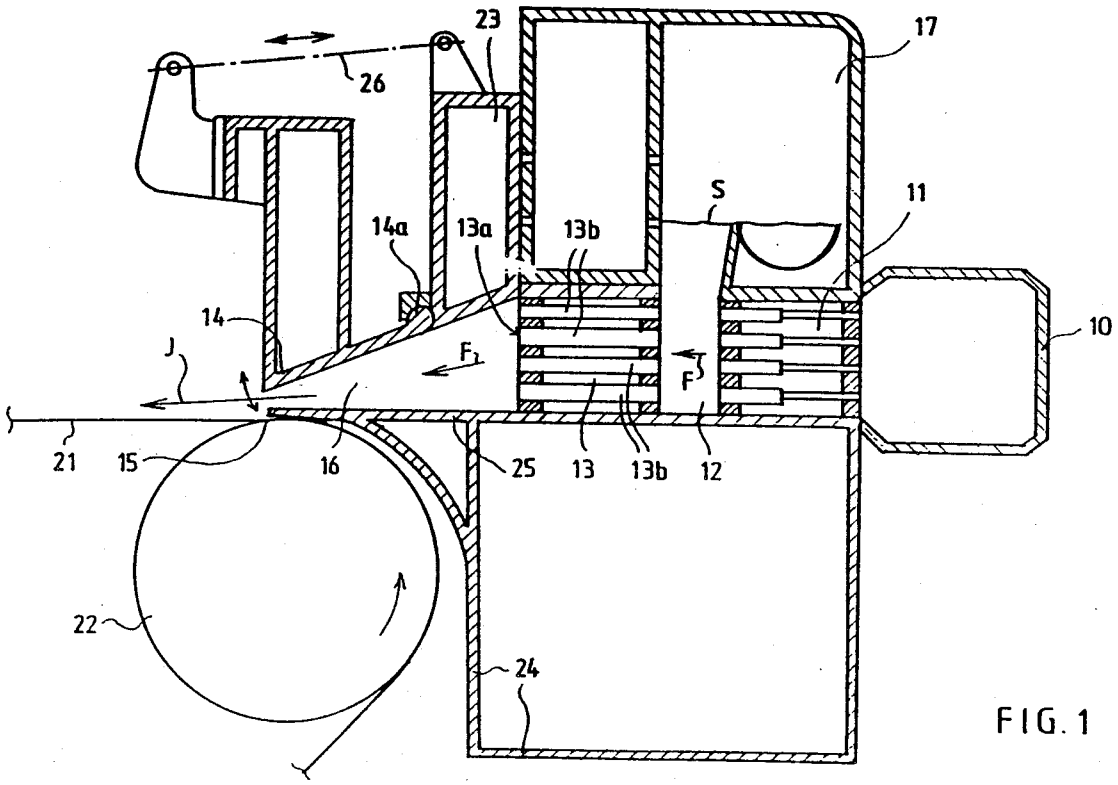
FIG. 1 shows a vertical machine direction cross section of a headbox in which the method according to the invention can be applied.
Figure 2:
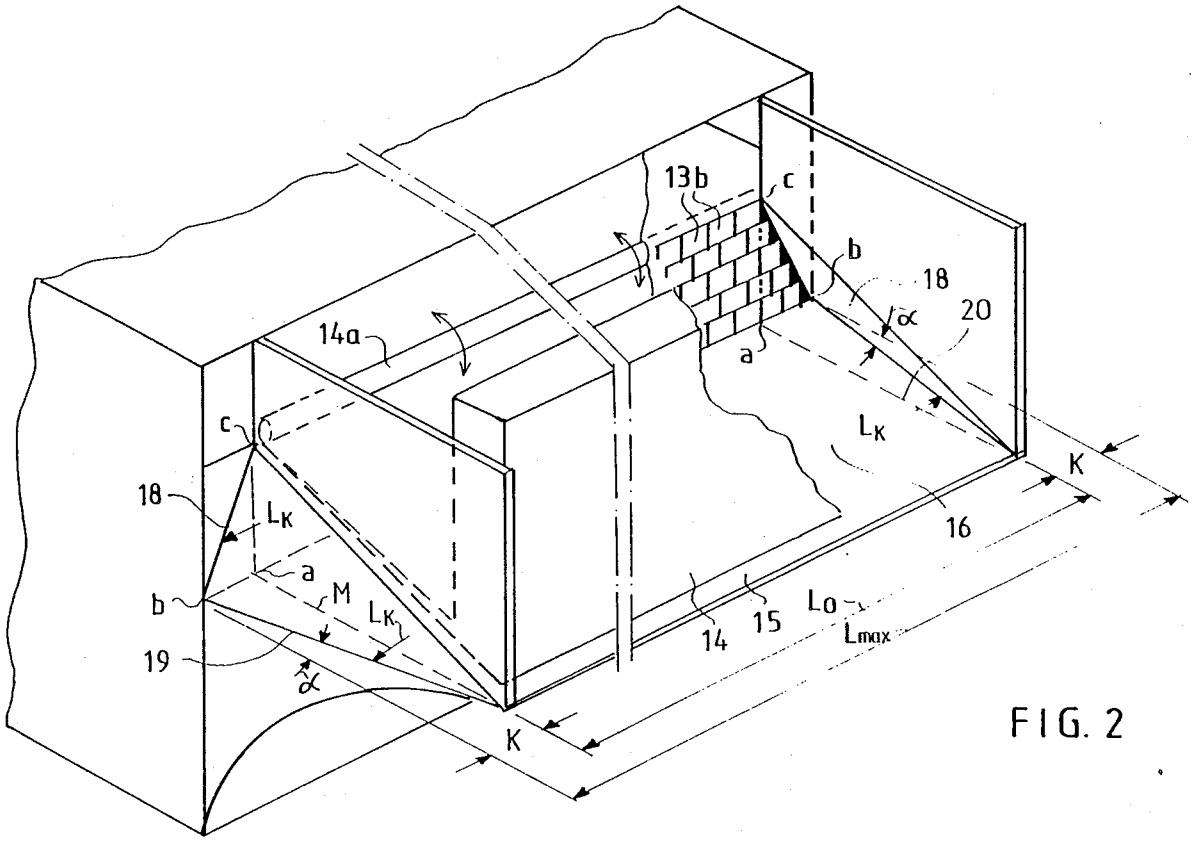
FIG. 2 shows an axonometric view of a headbox according to the invention.

FIGS. 1 and 2 show a hydraulic headbox, however, the method and apparatus of the invention can also be applied to so called open headboxes and/or those provided with a rectifier roll.

According to FIG. 1, the hydraulic headbox contains an inlet or cross header 10. A plurality of distribution tubes 11 are connected to the front wall of the cross header 10 which tubes lead the stock flows F to an equalizing chamber 12. The equalizing chamber 12 communicates at its upper end with an air tank 17, where the stock has a free surface S. On the flow route of the stock after the equalizing chamber 12 follows a turbulence generator 13, which has a plurality of parallel turbulence tubes or piping **13*b*. The outlet of the turbulence generator 13 opens to a slice channel 16. FIG. 2 shows the location of the square outlets of the discharge ends 13*a* of the piping 13*b* of the turbulence generator 13**.

A slice opening 15 is defined at the bottom thereof by a planar bottom wall 25 of an apron beam 24 and on its top by a planar upper wall 14 of a top lip beam 23, which wall is pivotally connected to the top lip beam 23 by a horizontal joint **14*a* movable by an actuator 26 for adjustment of the slice opening 15. A stock jet J is discharged through slice opening 15 onto a wire 21 that travels over a breast roll 22** or, in two-wire-formers, into a forming gap defined by the wires.

In the present invention stabilization of the jet flow J has been achieved by a new design of the slice channel or chamber 16. The width $L_0$ (FIG. 2) of the slice opening 15 of the slice channel 16 is narrower than the approach end of the slice channel 16, i.e. the mean width $L_K$ of the discharge end **13*a* of the turbulence generator 13, and the greatest width $L_{max}$ of the slice channel. Side walls 18 of the slice channel 16 are preferably not vertical in this invention, but inclined, as shown in FIG. 2, in the way that slice channel 16 converges at bottom wall 25 along line 19 starting from the discharge end 13*a* of the turbulence generator 13 from the width $L_{max}$ to slice width $L_0$, i.e. the sidewalls are inclined relative to a machine direction vertical plane towards the center of the slice channel. In previously known headboxes the vertical side walls follow dash line 20 drawn in FIG. 2. The width of the upper wall 14 of the slice channel 16 is substantially the same as the width of the slice opening $L_O$ of the slice channel 16**.

FIG. 2 shows that the side walls 18 of the slice channel 16 are made of inclined triangular planar sections. It is possible within the scope of the invention for the walls 18 to be vertical, and they can, when needed, be assembled from several planar sections and/or of one or more curved sections.

The degree of convergence K of the slice channel 16 in the flow direction according to the invention is $$K = \frac{L_{max} - L_0}{2}$$

and accordingly is dependent on the width of the machine. In general, the convergence is $K = k \times L_0$, wherein k is between about 0.5 and about 5%, and preferably k is between about 1.0 and about 2.0%.

According to the invention, the edge flows coming from the triangular areas a,b,c at the discharge end **13*a* of the turbulence generator 13** are directed to the edge areas of the web thus hindering the intrinsic thinning and spreading tendency of the edge areas of the web W. At the same time a velocity component is developed which is directed inwardly and in cross direction of the stock flow, which also lessens the unequal distribution and fiber orientation misalignment.

The degree of convergence K can also be expressed as convergence angle L, wherein L = K/M, and M is the length of slice channel 16 at the bottom wall 25. Convergence angle L is usually within the range of about 2.0° to about 7.5°, preferably within the range of about 4.5° to about 6.0°.

Figure 3:
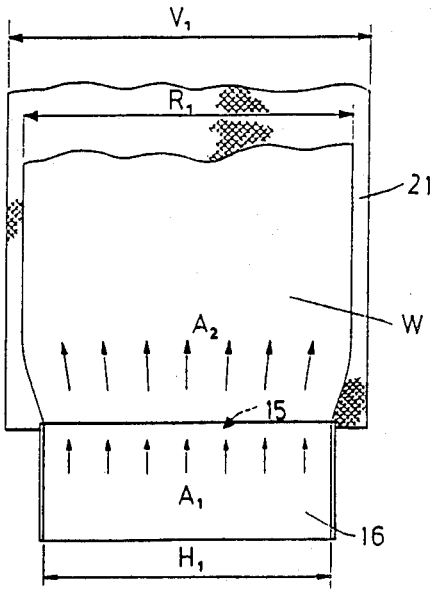
FIG. 3 PRIOR ART
FIG. 3 shows a horizontal section of the velocity vectors in the area of the slice opening of a previously known headbox.
Figure 4:
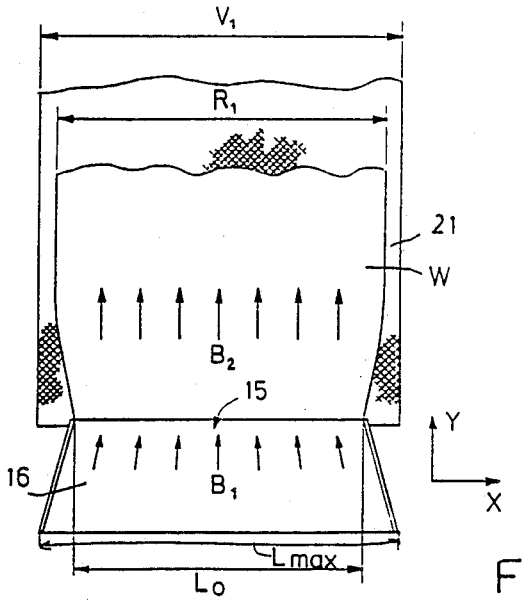
FIG. 4 shows velocity vectors of the stock in the area of a slice opening and in the area and around that of a stock jet discharged from a slice opening of a headbox according to the invention.

FIGS. 3 and 4 show the stock velocity vectors in a headbox slice channel and on a dewatering device, such as a wire.

FIG. 3 shows a horizontal cross section of a conventional, previously known headbox slice channel. The slice channel 16 is characterized in that its side walls are essentially parallel and its width is the same along the entire area of the channel (width $H_1$). This known headbox is characterized in that the stock velocity vectors $A_1$ in the slice channel are only composed of direction Y components. This is true about the entire width $H_1$ of the slice channel. The stock is discharged through the slice opening 15 whereby the width of the stock jet is equal to the width $H_1$ of the slice opening 16. It is, however, general knowledge that in being discharged onto the wire 21 (width $V_1$) the web W tends to spread towards the edges of the wire 21. Without exception, the consequence is a phenomenon directing the velocity vectors of the web W towards the edges of the web W. This leads to a situation where, at least a part of the velocity vectors $A_2$ are composed of both X-and Y-direction components. The absolute values of the X-components in question are not very high (< 0.5 m/s), but considering the fact that the difference between the jet flow and the wire 21 is very small, it is seen that the cross direction stock velocity component X is significant when relatively measured as is apparent from the following example.

| Example | |
|---|---|
| Velocity of jet flow | 20.00 m/s |
| Velocity of wire | 19.84 m/s |
| Difference in velocities | +0.16 m/c |
| Component of velocity vector X in edge area | 0.1 m/s |
| X-component/difference in velocities | 62.5% |

As the fibers flowing in the stock quickly follow the changes in direction of the velocity vectors, the phenomenon described above causes deviations in the fiber orientation particularly in the edge areas, which in turn cause the abovementioned drawbacks in the finished product.

FIG. 4 shows a horizontal cross section of a headbox slice channel 16 and part of a dewatering device, such as a wire according to the invention. The width of the slice channel 16 at the upstream end is $L_{max}$ and at the slice opening 15 it is $L_0$. As stated before, $L_{max}$ is greater than $L_0$. A headbox according to the invention is characterized in that at least part of the stock velocity vectors $B_1$ across the width $L_0$ of the slice opening 15 are composed of both X- and Y-direction components. In a headbox according to the invention at least the velocity vectors in the edge areas of jet flow J also include an X-direction component which is directed towards the mid section of the web. When the jet flow J described above is discharged onto the wire 21, some machine cross direction movement occurs, as stated before, particularly in the edge areas of the web. As a consequence, a velocity in the direction of the X-component is developed in the velocity vectors in the edge areas of web W which is, however, directed opposite to the component X caused by the convergence of the slice channel. These two oppositely directed components, substantially neutralize each other, and only a direction Y component of the velocity vector remains in an optimal case, in which case the fibers in the stock are also evenly orientated across the entire width $R_1$ of the web W. Thus by using a headbox according to the invention, the generally known phenomenon which causes nonhomogeneity of the paper technological properties of the edge areas of a fibrous web can be minimized or eliminated entirely.

While a preferred embodiment of the invention has been illustrated and described in detail, it is to be understood that changes therein and modifications thereof may be made within the scope of the invention which is defined in the appended claims.

What is claimed is:

1. A headbox for the delivery of a stock jet having a direction of flow to a moving forming wire comprising:

a slice channel having a machine direction vertical plane, a center, and an elongated slice opening; said slice channel being defined by a bottom wall and a top wall each extending in the direction of said elongation and by two opposed side walls extending between said bottom and top walls, said opposed side walls converging in a cross-flow direction toward said slicing opening;

and being substantially planar and inclined relative to said machine direction vertical plane toward the center of the slice channel.

2. The headbox of claim 1, additionally comprising a turbulence generator in fluid communication with said slice channel and located upstream thereof; the bottom width of said turbulence generator being larger than the top width thereof and larger than the width of said slice opening; said slice channel converging in the vicinity of said bottom wall substantially linearly from said bottom width of said turbulence generator to said slice opening, and in the vicinity of said top wall said slice channel having substantially the width of said slice opening along the length of said top wall.

3. The headbox of claim 1, wherein said side walls are positioned so that the width of the top wall of the slice channel along its machine direction length is substantially the same as the width of the slice opening; and the width of the bottom wall of the slice channel converges from a width larger than the width of the slice opening essentially linearly in the direction of stock jet flow toward said slice opening.

4. The headbox of claim 1, wherein said side walls are formed from one or more triangular sections.

5. The headbox of claim 1, wherein the degree of convergence of said side walls is within the range of from about 2.0° to about 7.5°.

6. The headbox of claim 1, wherein the degree of convergence of said walls is within the range of from about 4.5° to about 6.0°.

7. The headbox of claim 1, wherein the degree of convergence of said side walls is defined by the formula:

$$K=k\times L_0$$

wherein $L_0$ is the width of said slice opening and k is between about 0.5% and about 5.0%.

8. The headbox of claim 1, wherein the degree of convergence of said side walls is defined by the formula:

$$K=k\times L_o$$

wherein $L_0$ *is the width of said slice opening and k is between about* 1.0% and about 2.0%.

9. The headbox of claim 1, wherein said top wall is pivotable about the upstream edge thereof, and said to wall and said bottom wall being tapered toward each other and in the direction of flow of said stock jet.

10. A headbox for delivery of a stock jet having a direction of flow to a moving forming wire comprising:

an inlet header;

distribution tubes;

and a turbulence generator; said header, distribution tubes and turbulence generator being in fluid communication with each other;

a slice channel having a machine direction vertical plane, a center, and a downstream end and operatively connected said turbulence generator, comprising an elongated slice opening at said downstream end of said channel, a bottom wall and top wall extending in the direction of said elongation and being tapered toward each other in the direction of stock flow; two side walls extending between said bottom and top walls and being tapered along the length thereof and toward each other in the direction of stock jet flow, and said side walls being inclined relative to said machine direction vertical plane toward the center of the slice channel so that each of said side walls decrease the cross-sectional area of said slice channel along the length thereof transverse to the direction of stock jet flow; said top wall being pivotable at the upstream and end thereof for adjusting the slice opening;

and a beam located beneath said headbox and having an elongated top wall forming said bottom wall of said slice chamber.

* * * * *